US005197044A

United States Patent [19]

Pierce et al.

[11] Patent Number: 5,197,044

[45] Date of Patent: Mar. 23, 1993

[54] LOW ENERGY ANIMATED TIME PIECE

[75] Inventors: Harold D. Pierce, Woodland Hills, Calif.; Stephen C. Jacobsen; William B. Lee, both of Salt Lake City, Utah

[73] Assignee: Sounds Fun, Inc., Westlake Village, Calif.

[21] Appl. No.: 625,485

[22] Filed: Dec. 11, 1990

[51] Int. Cl.[5] ..... G04B 21/08

[52] U.S. Cl. ..... 368/63; 368/229; 368/281; 368/276

[58] Field of Search ..... 368/276, 280–282, 368/229, 63, 45, 272

[56] References Cited

U.S. PATENT DOCUMENTS

| | | | |
|---|---|---|---|
| D. 288,343 | 2/1987 | Ogawa | D21/144 |
| 344,922 | 7/1886 | Rebentisch | 368/220 |
| 373,441 | 11/1887 | Chase | 368/220 |
| 2,026,990 | 1/1936 | Manning | 46/171 |
| 2,165,037 | 7/1939 | Ellis et al. | 175/336 |
| 2,671,863 | 3/1954 | Matthews | 310/36 |
| 2,863,103 | 12/1958 | Tancred | 317/197 |
| 2,926,487 | 3/1960 | Stone | 368/220 |
| 3,021,666 | 2/1962 | Stone | 368/220 |
| 3,287,849 | 11/1966 | Weiss | 46/232 |
| 3,660,932 | 5/1972 | Raffeli et al. | 46/235 |
| 3,828,469 | 8/1974 | Giroud | 46/245 |
| 4,484,408 | 11/1984 | Fagarty et al. | 446/299 |
| 4,571,199 | 2/1986 | Murakami | 446/73 |
| 4,843,497 | 6/1989 | Leyden | 360/79 |

OTHER PUBLICATIONS

Article entitled "Introducing . . . Talk".

*Primary Examiner*—Bernard Roskoski

*Attorney, Agent, or Firm*—Fulwider, Patton, Lee & Utecht

[57] ABSTRACT

A wristwatch mounting an animated head of a figure and including a moveable nose overlying a watch face and formed by one end of a moveable member, the opposite end forming an armature. The moveable member is mounted on a laterally extending pivot pin such that magnitude of the torque due by the gravitational pull on such centers of mass on the opposite sides of such pivot pin are equal. An electrical circuit is provided with an actuation switch that may be pressed to actuate an audio speaker which emits a simulated time indicating voice in synchronism with intermittent energization of such armature to selectively move such nose between mouth open and mouth closed positions.

9 Claims, 2 Drawing Sheets

LOW ENERGY ANIMATED TIME PIECE

BACKGROUND OF THE INVENTION

1. Field of the Invention

The present invention relates to a battery powered animated figures.

2. Description of the Prior Art

The popularity of novelty wrist watches and the like has led to the development of numerous different styles of watches displaying different novelty figures on the faces thereof, some incorporating a depiction of the hands of such figures as the hands of sweep hand on the faces of such watches.

The popularity of cartoon and television characters have led to the proposal of watches incorporating three dimension depictions of such characters. Devices of this type are shown in U.S. Pat. No. 288,343 to Owaga. Watches of these types, while being satisfactory for their intended uses fail to incorporate animated three dimensional figures.

There has long existed a need for a wrist watch device incorporating a three dimensional novelty figure with an animated portion which could be powered by conventional electric watch batteries without consumption of undue energy.

In effort to overcome this problem, the present invention incorporates an armature which is selectively energized to move an animated figure part and which is also balanced against the weight of such animated part. While balanced armatures have been proposed in the past for relays, switches and the like, none of those devices have been generally accepted in a wrist watch construction employing an animated figure.

The animated wrist watch of the present invention also addresses the problem associated with application of high acceleration forces to the animated figure part and associated armature resulting from rapid wrist movement. While attention has, in the past, been given to efforts to minimize forces imposed on dynamic parts as a result of forces of acceleration, none have attained optimum results in minimizing forces applied to moveable figure parts in a wrist watch apparatus.

SUMMARY OF THE INVENTION

The wrist watch apparatus of the present invention is characterized by an animated novelty figure incorporating an elongated pivotable member formed on one extremity with an animated figure part and on the opposite end with an armature portion disposed in the magnetic field of a magnet. The pivotable member is balanced on a transverse pivot pin to thus minimize the torque required to pivot and to minimize any imbalance due to acceleration induced forces.

Preferably, the pivot member is configured such that an axis formed by a straight line between the centers of mass on opposite sides of the axis substantially intersects the axis of the pivot pin to thereby further minimize the effect of acceleration forces applied to such moveable member. Further, a ferromagnetic pull pin may be mounted on the armature in such a position that it will be normally drawn by such magnet to a position where the moveable figure part in a preferred position.

DESCRIPTION OF THE PREFERRED EMBODIMENT

Figure 2:
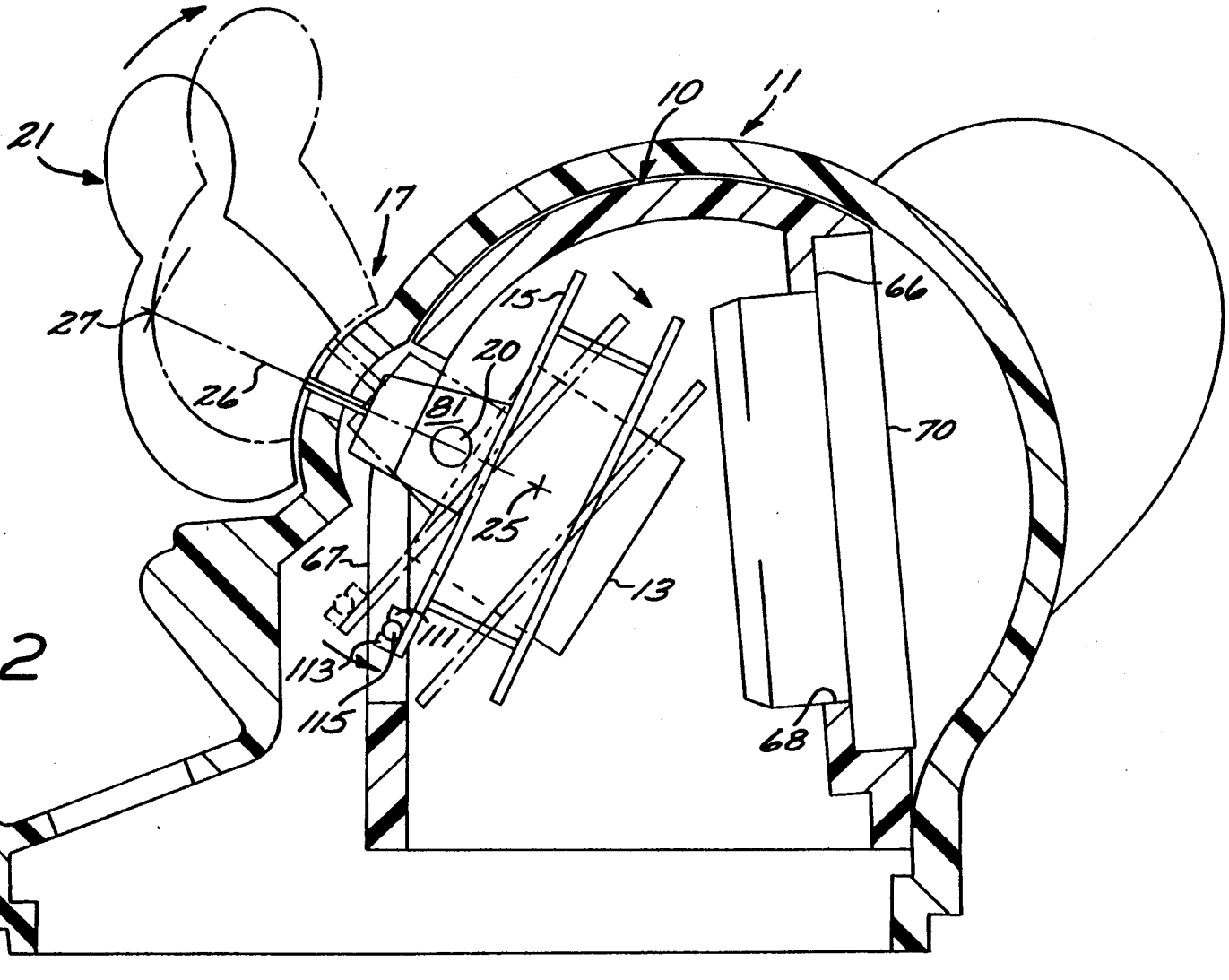
FIG. 2 is a cross sectional view, in enlarged scale, of the wrist watch shown in FIG. 1 but in its assembled configuration.

The animated time device of the present invention includes, generally, a housing 10 (FIG. 2) covered by a hood 11 simulating the configuration of a novelty figure such as a well known cartoon character as, for example, Mickey Mouse's head. A permanent magnet 13 received within the opening of a generally donut shaped bobbin defining an armature 15. The armature 15 is formed by one end of a pivotable member, generally designated 17, mounted on a pivot pin 20, the opposite end thereof simulating the nose 21. Because the weight of the moveable member 17 is about ⅓ that of the armature 15, so as to minimize the energy required to rotate such moveable member about the pivot pin 20, the center of mass 27 for the nose portion 21 is spaced about three times as far from such pivot pin as that for the center of mass 25 for the armature 15. Consequently, upon controlled intermittent energization of the armature 15, the moveable member 17, and consequently the nose 21, will be rotated about the pivot pin 20 in accordance with a predetermined signal to thereby simulate talking by the figure.

Figure 1:
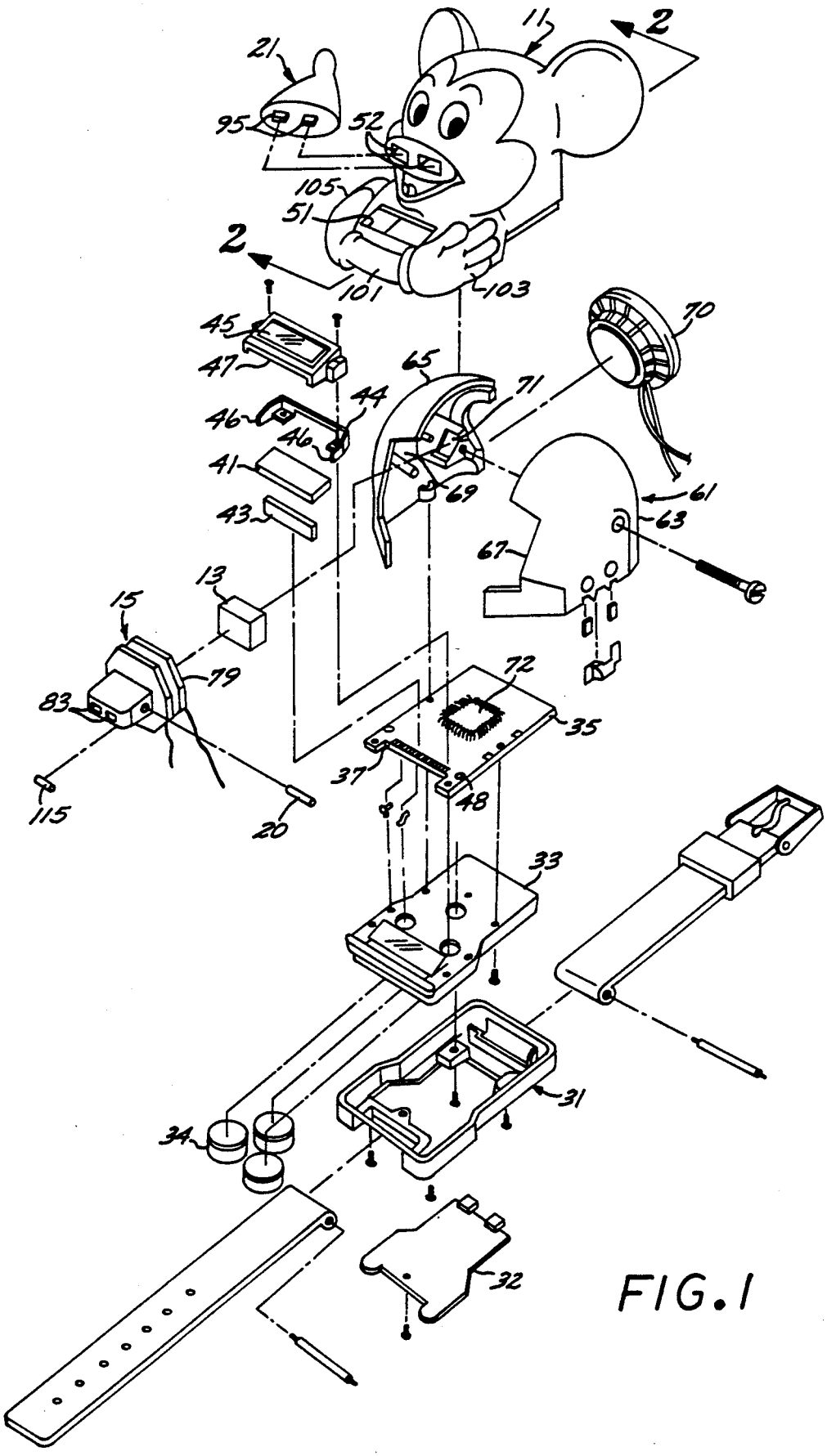
FIG. 1 is an exploded view of an animated wrist watch embodying the present invention.

The wrist watch depicted in FIG. 1 includes, generally, a conventional frame back 31 covered on one side by a back wall 32 and opening upwardly for receipt in stacked fashion a formed plate defining a battery bay 33 for receipt of conventional watch batteries 34. A printed circuit board 35 overlies the battery bay 33, mounts contacts 48 on the opposite sides thereof and is formed with a forwardly opening notch 37. Received in such notch 37 is a rectangular LCD 41 which overlies an LCD connector 43 and is positioned for viewing through a window 45 formed in an LCD frame 47, such window being disposed in alignment with a window 51 in the hood 11.

A U-shaped, electrically conductive audio switch contact actuator 44 overlies the printed circuit board 35 and is formed with a pair of laterally disposed resilient wings 46 having respective free ends which, in the assembled configuration, are normally spaced from the respective contacts 48 to thus provide a normally open switch. Closure of such contact actuator 44 on such contacts 48 then grounds the circuit to actuate a voice memory that drives the armature 15 to initiate controlled actuation of the nose 21 in synchronization with a recorded voice memory.

The hood 11 is of an injection molded mask type figure constructed of, for instance, polyvinylchloride and is received over an interior somewhat semi-spherically shaped shell defining the skull housing 10.

The hood 11 is formed in the mouth area with forwardly opening slots 52 which confront the forward end of the pivotable member 17. The hood is formed in its lower forward section with a configuration depicting a wrap-around arms 101 having hands 103 and 105 disposed on the opposite sides thereof for being disposed in confronting relationship over the wings 46 of the contact actuator 44 such that upon pressing such hands together the wings will engage the contacts 48 to ground the circuit 72 and initiate the voice memory to actuate the speaker 70 and the armature 15 in synchronism therewith.

The nose 21 of the figure is then formed with rearwardly projecting tabs 95 which project through the slots 52. The skull housing 10 is constructed of two clam shell halves 63 and 65, formed with respective forwardly facing notches 67 and 69 disposed in confronting relationship with the nose 21.

The interior of the back of the skull housing halves 63 and 65 are formed with upwardly and forwardly facing platens 71 which cooperate to form a mount for the generally rectangular shaped magnet 13 (FIG. 1). Formed in the back wall of the respective skull housing halves 63 and 65 is a mounting recess 66 into which a circular opening 68 is formed for receipt of a speaker 70 connected into a circuit 72 (FIG. 1) with the batteries 34 and armature 15 for selected actuation thereof to emit a preestablished voice.

The armature 15 includes a frame formed with a spaced apart planer rings defining a bobbin 79 mounting a forwardly projecting tongue 81. Formed medially in the tongue 81 is a transversely projecting bore 85 for receipt of the pivot pin 20 which serves to pivotally mount the assembled pivot member 17 from the skull halves 63 and 65. The tongue 81 terminates in its front face with a pair of forwardly opening slots 83 confronting the slots 52 in the hood 11 (FIG. 1). The frame of the armature 15 is formed in its lower forward portion with forwardly projecting parallel flanges 111 and 113 spaced apart for receipt therebetween of a soft iron wire segment 115 which serves as a ferromagnetic pull disposed in the magnetic field of the magnet 13 to thus normally bias the pivotal member 17 to its counterclockwise position disposing the nose 21 in its closed position.

So as to minimize the effects of acceleration induced forces, the centers of mass 25 and 27 of the respective armature 15 and nose 21 are preferably arranged on a straight line defining a balance axis 26 which intersects the axis of the pivot pin 20 to thus result in the cumulative acceleration induced forces acting essentially through the axis of the pivot pin 20 thereby nullifying any cumulative torque which might otherwise resist or assist rotation of the pivotable member 17 about its axis pin 20.

Thus, in operation, the batteries 34 are typically operative to drive the LCD 41 to display the current time. When the wearer of the watch, for instance a young child, moves his wrist about in a rapid manner, acceleration forces will be applied to the watch itself and, of course, to the moveable member 17.

It will be appreciated by those skilled in the art that since the axis 26 of the pivot member 17 extending between the centers of mass 25 and 27 essentially intersect the pivot axis formed by the pivot pin 20, the effect of the various acceleration forces in opposing rotation about such pin will be minimized. It has been found that, even if such an ideal configuration is not practical, for the embodiment shown, the perpendicular distance (i.e. shortest distance) from such axis 26 to the axis of the pivot pin should be no greater than about 0.1 inches.

For the particular configuration shown, the nose portion 21 weighs about nine grams and the armature section 15 about 2.7 grams thus affording the ratio of approximately 3 to 1. With the center of mass of the coil located about three centimeters from the axis of the pivot pin 20 and that for the nose section about one centimeter from such pivot axis, it has been discovered that the static equilibrium will be afforded, thus maintaining the net torque necessary to reciprocate the pivotal member 17 substantially constant.

When it is then desired to actuate the animated mechanism, the hands 103 and 105 (FIG. 1) are pressed inwardly toward one another thus closing the wings 46 of the contact actuator 44 on the contracts 48 to ground the circuit 42 as described above. This acts to energize the voice memory to drive the speaker 70 and pivotable member 17 to move the nose 21 to synchronize with the voice. In this regard, when the armature is energized its magnetic field will tend to align with that of the magnet 13 thus overcoming the attraction of the pull wire 115 to such magnet. This will serve to rotate the armature 15 and consequently the pivot member 17 counterclockwise about the pivot pin 20 to drive the nose portion 21 upwardly (FIG. 1). Once the electrical signal to the armature 15 is discontinued, the magnetic attraction on the pull wire 115 will rotate the pivotal member 17 counterclockwise to close the nose portion 21. This movement is synchronized in a manner well known to those skilled in the art with voice fluctuation emitted from the speaker 70 to simulate speaking of the figure.

It will be appreciated that the magnetic pull on the pull pin, while of a relatively small magnitude, will be sufficient to, in effect bias the nose 21 to the mouth closed position without application of independent biasing forces which would otherwise have to be overcome to effect manipulation of the nose 21.

From the foregoing, it will be apparent that the animated wrist watch of the present invention is inexpensive to manufacture and reliable to operate. Operation of the animation requires only minimal power thus leading to a long and trouble free service life.

I claim:

1. An animated time piece comprising:

a housing;

a figure mounted on said housing and including stationary and moveable figure parts;

an elongated pivotable member mounting said movable figure part on one extremity thereof and cooperating therewith to form a figure part center of mass, said pivot member being configured on the opposite extremity with an armature portion having an armature center of mass;

a laterally projecting pivot pin interposed between said centers of mass for mounting said pivotable member from said housing so as to balance said centers of mass on the opposite sides of said pivot pin;

a magnet mounted on said housing;

said pivot member being pivotable about said pivot pin and said armature being operative to, upon application of a predetermined electrical signal, cooperate with said magnet to pivot said pivot member to shift said moveable figure part from a first to a second position;

means coupled with said pivot member for normally urging said moveable figure part to said first position;

electrical means, including a battery, timing means and signal generating means operative to periodically generate said predetermined electrical signal to thereby selectively energize said armature to cause said figure part to shift from said first to said second position; and means for displaying time disposed in said housing and means for synchronizing movement of said pivot member with time annunciating means.

2. An animated time piece according to claim 1 wherein:

said pivot member is configured such that a straight line drawn between said first and second centers of mass passes substantially through said pivot pin.

3. An animated time piece according to claim 2 wherein:

said pivotable member is so configured that said straight line, at its closest point, is spaced no more than 0.1 inches from the axis of said pivot pin to thereby minimize gravity induced torque thereon.

4. An animated time piece according to claim 1 wherein:

said housing includes a wrist watch strap for fastening to a wearer's wrist.

5. An animated time piece according to claim 1 that includes:

a ferromagnetic return pull wire spaced laterally of a straight line drawn between said centers of mass and wherein;

said armature includes return pull mounting means for mounting said return pull wire such that the magnetic field of said magnet will draw said moveable figure part to said second position.

6. An animated time piece according to claim 1 wherein:

said figure depicts a head shape;

said moveable part is in the form of a nose complementing said head shape and formed with at least one connector tab; and said pivotable member includes at least one slot for receipt of said tab to hold said nose in position.

7. An animated time piece according to claim 1 wherein:

said electrical means includes actuating means operative in response to a selected electrical signal to actuate said signal generating means and manually operable switch means for selectively generating said selected electrical signal.

8. An animated time piece according to claim 7 wherein:

said housing includes a pliable hood formed with said figure and including a simulated figure part overlying said switch and pliable to be flexed for activating of said switch means.

9. An animated time piece according to claim 1 wherein said time annunciating means includes a voice generating means.

* * * * *